US011664153B2

(12) United States Patent
Yang et al.

(10) Patent No.: US 11,664,153 B2
(45) **Date of Patent: *May 30, 2023**

(54) COIL COMPONENT

(71) Applicant: SAMSUNG ELECTRO-MECHANICS CO., LTD., Suwon-si (KR)

(72) Inventors: Ju Hwan Yang, Suwon-si (KR); Byeong Cheol Moon, Suwon-si (KR); Byung Soo Kang, Suwon-si (KR); Yoon Mi Cha, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 811 days.

This patent is subject to a terminal disclaimer.

(21) Appl. No.: 16/566,244

(22) Filed: Sep. 10, 2019

(65) Prior Publication Data

US 2020/0168391 A1 May 28, 2020

(30) Foreign Application Priority Data

Nov. 26, 2018 (KR) ..... 10-2018-0147489

(51) Int. Cl.
*H01F 27/29* (2006.01)
*H01F 17/00* (2006.01)
(Continued)

(52) U.S. Cl.
CPC ..... *H01F 27/292* (2013.01); *H01F 17/0013* (2013.01); *H01F 17/04* (2013.01);
(Continued)

(58) Field of Classification Search
CPC .... H01F 27/292; H01F 17/0013; H01F 17/04; H01F 27/2804; H01F 2017/048; H01F 27/255
(Continued)

(56) References Cited

U.S. PATENT DOCUMENTS 9,583,251 B2 * 2/2017 Moon ..... H01F 17/0013
9,659,704 B2 * 5/2017 Yang ..... H01F 27/292
(Continued)

FOREIGN PATENT DOCUMENTS

CN 107658095 A 2/2018
CN 113948272 A * 1/2022 ..... H01F 27/255
(Continued)

OTHER PUBLICATIONS

Chinese Office Action dated Oct. 17, 2022, issued in corresponding Chinese Patent Application No. 201911171034.6.

*Primary Examiner* — Mang Tin Bik Lian
*Assistant Examiner* — Joselito S. Baisa
(74) *Attorney, Agent, or Firm* — Morgan, Lewis & Bockius LLP

(57) ABSTRACT

A coil component includes a body having one surface and the other surface opposing each other and including a magnetic metal powder particle and an insulating resin; a coil portion embedded in the body and having end portions respectively exposed from end surfaces of the body; first and second external electrodes arranged to be spaced apart from each other on the one surface and extending to the end surfaces to be connected to the end portions, respectively; and an external insulating layer disposed between each of the first and second external electrodes and the one surface of the body. A magnetic metal powder particle exposed on the wall surface of the body, among the magnetic metal powder particle, has a plating prevention film disposed on at least a portion of a surface of the exposed magnetic metal powder particle and including metal ions of the magnetic metal powder particle.

20 Claims, 7 Drawing Sheets

B

(51) Int. Cl.
*H01F 17/04* (2006.01)
*H01F 27/255* (2006.01)
*H01F 27/28* (2006.01)
*H01F 41/04* (2006.01)

(52) U.S. Cl.
CPC ..... *H01F 27/255* (2013.01); *H01F 27/2804* (2013.01); *H01F 41/041* (2013.01); *H01F 2017/048* (2013.01)

(58) Field of Classification Search
USPC ..... 336/200
See application file for complete search history.

(56) References Cited

U.S. PATENT DOCUMENTS 9,728,316 B2 * 8/2017 Mimura ..... H01F 41/046
9,984,805 B2 * 5/2018 Kudo ..... H01F 17/0013
2012/0274429 A1 * 11/2012 Ogawa ..... H01F 1/26 335/299
2015/0115776 A1 * 4/2015 Terashita ..... H01F 27/29 336/200
2015/0371752 A1 * 12/2015 Park ..... H01F 27/255 336/200
2016/0055955 A1 * 2/2016 Park ..... H01F 27/255 336/83
2016/0086716 A1 3/2016 Choi et al.
2016/0217920 A1 * 7/2016 Choi ..... H01F 41/046
2016/0268038 A1 9/2016 Choi
2017/0084376 A1 3/2017 Kubota et al.
2017/0162319 A1 * 6/2017 Otani ..... H01G 4/2325
2017/0169930 A1 * 6/2017 Kudo ..... H01F 17/0013
2017/0271081 A1 * 9/2017 Maki ..... H01G 4/248
2018/0033540 A1 2/2018 Lee et al.
2018/0137965 A1 5/2018 Lee
2020/0098506 A1 * 3/2020 Hamada ..... H01F 41/0233

FOREIGN PATENT DOCUMENTS

JP 2007-165477 A 6/2007
JP 2017103243 A * 6/2017 ..... G02B 5/02
KR 10-2016-0033463 A 3/2016
KR 10-2016-0040422 A 4/2016
KR 10-2016-0108935 A 9/2016
KR 10-2017-0020442 A 2/2017
KR 10-2018-0028360 A 3/2018
KR 10-2018-0054266 A 5/2018

* cited by examiner

COIL COMPONENT

CROSS-REFERENCE TO RELATED APPLICATION(S)

This application claims benefit of priority to Korean Patent Application No. 10-2018-0147489 filed on Nov. 26, 2018 in the Korean Intellectual Property Office, the disclosure of which is incorporated herein by reference in its entirety.

TECHNICAL FIELD

The present disclosure relates to a coil component.

BACKGROUND

An inductor, a coil component, is a typical passive electronic component used in electronic devices, along with a resistor and a capacitor.

With higher performance and smaller sizes gradually implemented in electronic devices, coil components used in electronic devices have been increasing in number and becoming smaller.

In the case of a thin film type inductor, a magnetic composite sheet including magnetic metal powder particles is stacked and cured on a substrate on which a coil portion is formed using a plating process, to form a body, and external electrodes are formed on a surface of the body.

In order to reduce thicknesses of the components, the external electrodes may be formed using a plating process. In this case, a magnetic metal powder particle exposed from the surface of the body may cause plating blur.

SUMMARY

An aspect of the present disclosure is to provide a coil component capable of preventing deteriorations in reliability due to plating blur in a plating process for forming external electrodes.

Another aspect of the present disclosure is to provide a coil component which may be lighter, thinner, shorter, and smaller.

Another aspect of the present disclosure is to provide a coil component having an improved breakdown voltage (BDV) by increasing an insulation distance between external electrodes.

According to an aspect of the present disclosure, a coil component includes a body having one surface and the other surface opposing each other, having a plurality of wall surfaces respectively connecting the one surface and the other surface, and including a magnetic metal powder particle and an insulating resin; a coil portion embedded in the body and having end portions respectively exposed from end surfaces opposing each other, among the plurality of wall surfaces of the body; first and second external electrodes arranged to be spaced apart from each other on the one surface of the body and extending to the end surfaces of the body to be connected to both end portions of the coil portion, respectively; an external insulating layer disposed between each of the first and second external electrodes and the one surface of the body; and a cover insulating layer disposed on the other surface of the body and the plurality of wall surfaces of the body, to cover at least a portion of each of the first and second external electrodes. A magnetic metal powder particle exposed on the wall surface of the body, among the magnetic metal powder particle, has a plating prevention film disposed on at least a portion of a surface of the exposed magnetic metal powder particle and including metal ions of the magnetic metal powder particle.

According to an aspect of the present disclosure, a coil component includes a body comprising a magnetic metal powder particle and an insulating resin; a coil portion embedded in the body; first and second external electrodes arranged to be spaced apart from each other on one surface of the body, and extending to end surfaces of the body to be connected to end portions of the coil portion, respectively; and an external insulating layer disposed between each of the first and second external electrodes and the one surface of the body. An oxide film is at least partially embedded in the body and covers only a portion of the magnetic metal powder particle, and the magnetic metal powder particle covered by the oxide film is spaced apart from the one surface of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
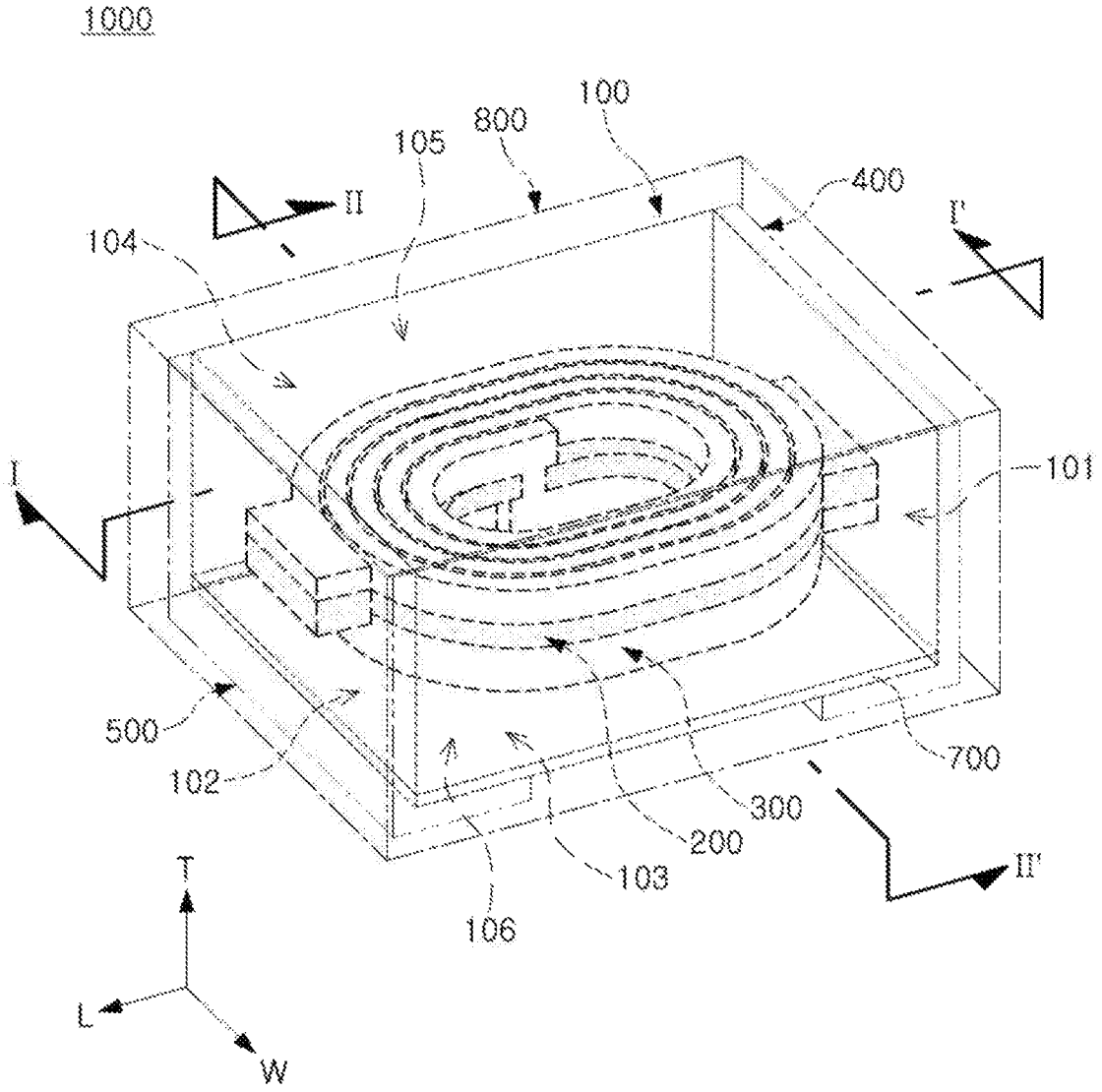
FIG. 1 is a schematic view illustrating a coil component according to a first embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (longitudinal) direction, a W direction is a second direction or a width direction, a T direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment

Figure 2:
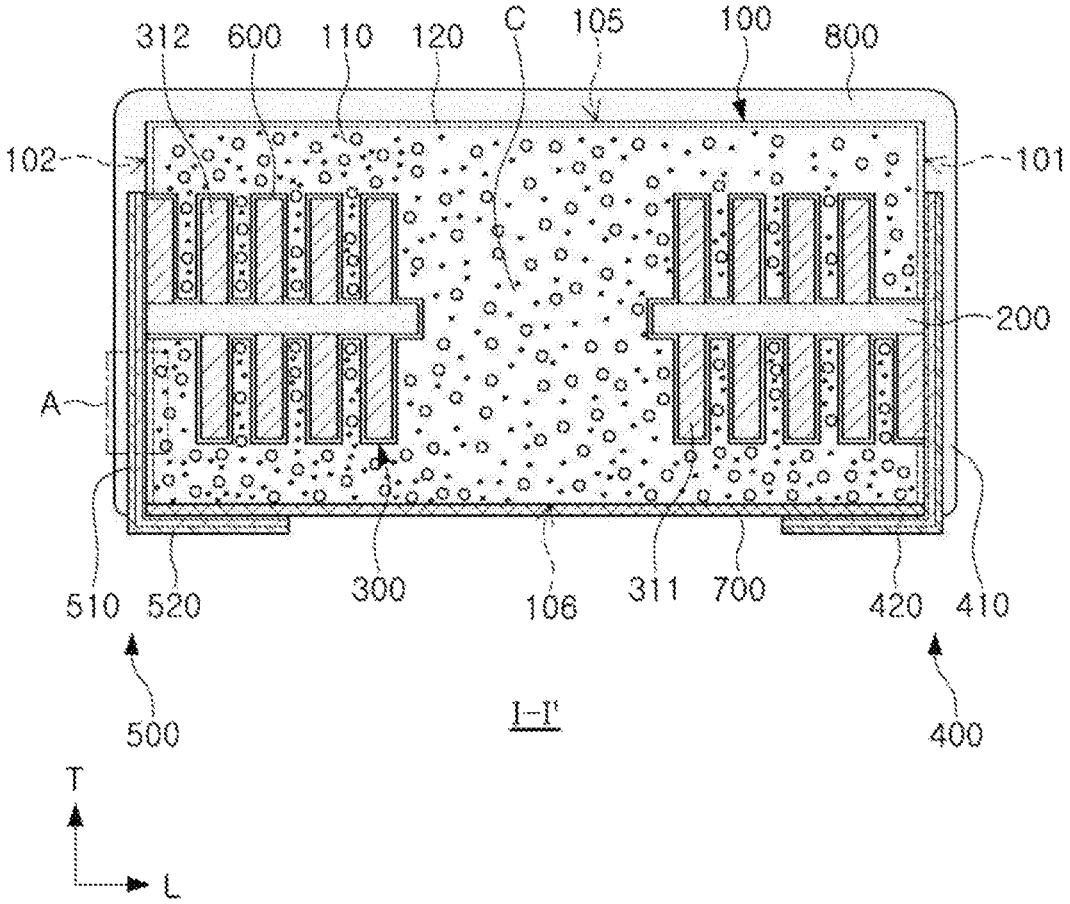
FIG. 2 is a cross-sectional view taken along line I-I' of FIG. 1.
Figure 3:
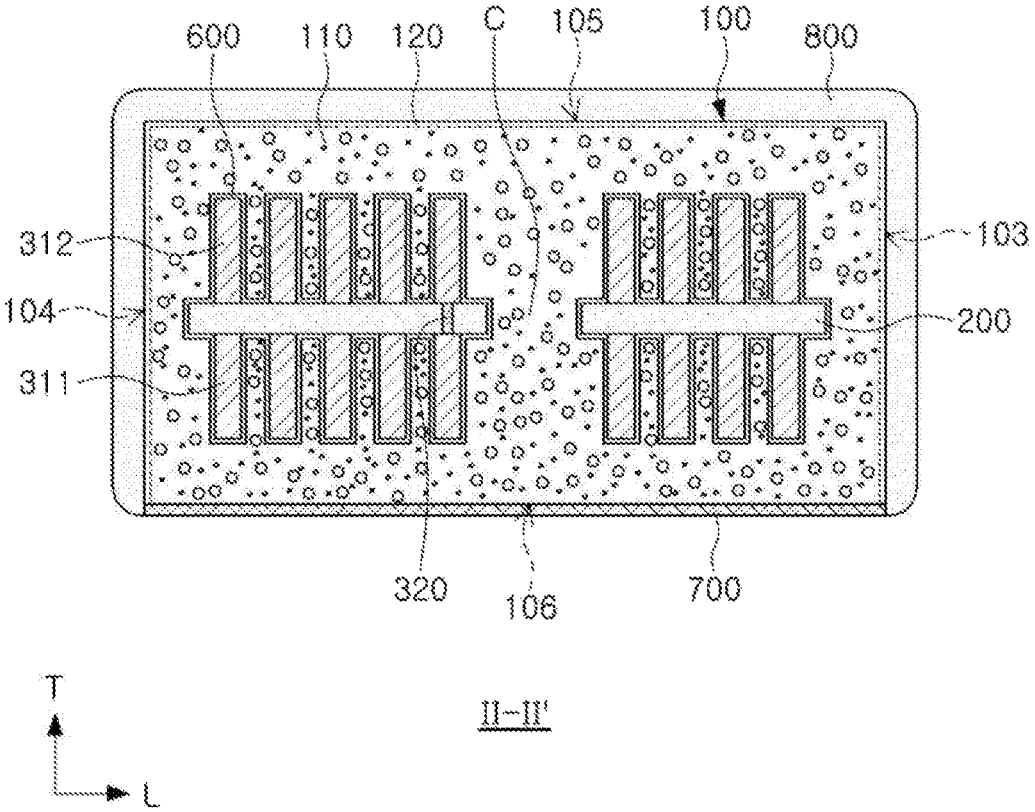
FIG. 3 is a cross-sectional view taken along line II-II' of FIG. 1.
Figure 4:
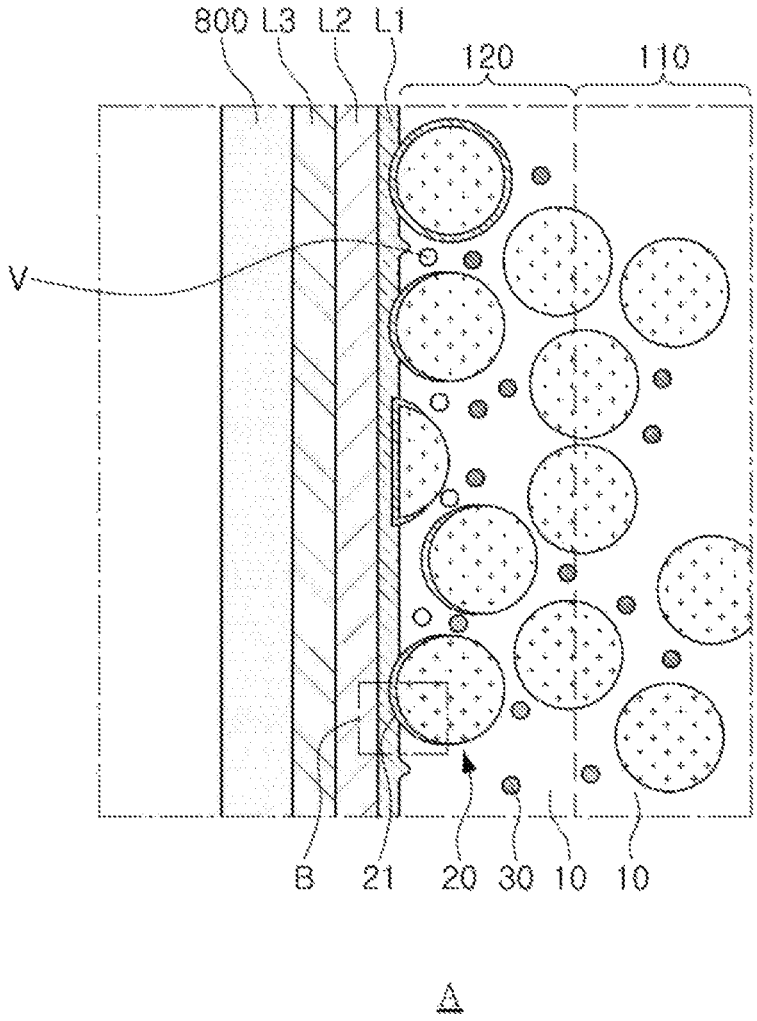
FIG. 4 is an enlarged view of portion A of FIG. 1.
Figure 5:
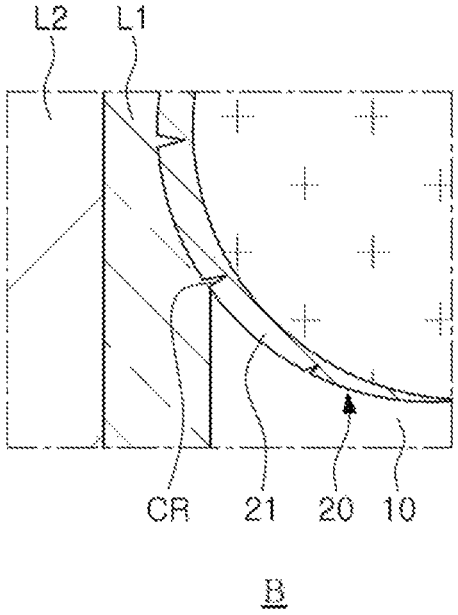
FIG. 5 is an enlarged view of portion B of FIG. 4.

FIG. 1 is a schematic view illustrating a coil component according to a first embodiment of the present disclosure. FIG. 2 is a cross-sectional view taken along line I-I' of FIG. 1. FIG. 3 is a cross-sectional view taken along line II-II' of FIG. 1. FIG. 4 is an enlarged view of portion A of FIG. 1. FIG. 5 is an enlarged view of portion B of FIG. 4.

Referring to FIGS. 1 to 5, a coil component 1000 according to an embodiment of the present disclosure may include a body 100, an inner insulating layer 200, a coil portion 300, external electrodes 400 and 500, and an insulation film 600.

The body 100 may form an exterior of the coil component 1000 according to this embodiment, and the coil portion 300 may be embedded therein.

The body 100 may be formed to have a hexahedral shape overall.

Referring to FIGS. 1 to 3, the body 100 may include a first surface 101 and a second surface 102 opposing each other in a longitudinal direction L, a third surface 103 and a fourth surface 104 opposing each other in a width direction W, and a fifth surface 105 and a sixth surface 106 opposing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body, and both side surfaces of the body 100 may refer to the third surface 103 and the fourth surface 104 of the body. Further, one surface and the other surface of the body 100 may refer to the sixth surface 106 and the fifth surface 105 of the body 100, respectively.

The body 100 may be formed such that the coil component 1000 according to this embodiment in which the external electrodes 400 and 500 to be described later are formed has a length of 2.0 mm, a width of 1.2 mm, and a thickness of 0.65 mm, but is not limited thereto.

The body 100 may include magnetic metal powder particles 20 and 30 and an insulating resin 10, and may have an internal portion 110 and an outer portion 120 constituting first to fifth surfaces 101, 102, 103, 104 and 105 of the internal portion 110.

Specifically, the body 100 may be formed using stacking at least one magnetic composite sheet containing the insulating resin 10 and the magnetic metal powder particles 20 and 30 dispersed in the insulating resin 10.

The magnetic metal powder particles 20 and 30 may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particles 20 and 30 may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The magnetic metal powder particles 20 and 30 may be amorphous or crystalline. For example, the magnetic metal powder particles 20 and 30 may be a Fe—Si—B—Cr-based amorphous alloy powder, but are not limited thereto. The magnetic metal powder particles 20 and 30 may have an average diameter of 0.1 μm to 30 μm, respectively, but are not limited thereto.

The magnetic metal powder particles 20 and 30 may include a first powder particle 20 and a second powder particle 30 having a particle diameter smaller than a particle diameter of the first powder particle 20. In the present specification, the term "particle diameter" refers to a particle size distribution represented by $D_{90}$ or $D_{50}$. In the case of the present disclosure, since the magnetic metal powder particles 20 and 30 include the first powder particle 20 and the second powder particle 30 having a particle diameter smaller than that of the first powder particle 20, the second powder particle 30 may be disposed in a space between the first powder particles 20 to improve a filling ratio of the magnetic material in the body 100.

The insulating resin 10 may include an epoxy, a polyimide, a liquid crystal polymer, or the like, in a single form or in combined forms, but is not limited thereto.

The outer portion 120 may constitute the first to fifth surfaces 101, 102, 103, 104, and 105 of the body 100. The outer portion 120 may be formed to surround the upper surface and the four side surfaces of the internal portion 110 except for the lower surface of the internal portion 110, based on the directions of FIGS. 1 to 3. The internal portion 110 and the outer portion 120 of the body 100 may be not formed as separate members. For example, the outer portion 120 may be a region of the body 100 corresponding to an etching depth of an acid solution in an acid treatment, which will be described later, and may be described to be distinguished from the internal portion 110. As a non-limiting example, the outer portion 120 may be defined as a depth of about 1.5 times than a particle size of the first powder particle 20, described above, from each of the first to fifth surfaces 101, 102, 103, 104, and 105 of the body 100. Since the external insulating layer 700 to be described later is disposed on the sixth surface 106 of the body 100 during the acid treatment process for forming the outer portion 120 in this embodiment, the external insulating layer 700 may prevent the acid solution applied in the acid treatment process from permeating to a portion of the body 100 covered by the external insulating layer 700. As such, a portion of the body 100 within a depth of, for example, 1.5 times a particle size of the first powder particle 20, from the external insulating layer may not have properties corresponding to the outer portion 120. Such a portion of the body 100 may have properties the same as, or similar to, those of the internal portion 110. That is, the outer portion 120 may be formed only on the first to fifth surfaces 101, 102, 103, 104, and 105 of the body 100. The outer portion 120 of the present disclosure may be distinguished from the technique that a separate insulating layer is stacked or coated on the surface of the body 100, after the formation of the body 100. The acid solution for forming the outer portion 120 may react with the magnetic metal powder particles 20 and 30, and may not react with both end portions of the coil portion 300 exposed from the first and second surfaces 101 and 102 of the body 100.

The magnetic metal powder particles 20 and 30 disposed in the outer portion 120 may have a plating prevention film 21 on at least a portion of a surface of each of the magnetic metal powder particles 20 and 30. For example, the magnetic metal powder particles 20 and 30 exposed from the first to fourth surfaces 101, 102, 103, and 104 of the body 100, among the magnetic metal powder particles 20 and 30 disposed in the outer portion 120, may have a plating prevention film 21 on at least a portion of a surface of each of the magnetic metal powder particles 20 and 30. The magnetic metal powder particles 20 and 30 which may be covered with the insulating resin 10 and may not be exposed from the surface of the body 100, among the magnetic metal powder particles 20 and 30 disposed in the outer portion 120, may also have a plating prevention film 21 on at least a portion of a surface of each of the magnetic metal powder particles 20 and 30. The latter case may be because an acidic solution passes through to a boundary between the outer portion 120 and the internal portion 110 in the body 100 in an acid treatment of the body 100 due to a porous structure of the insulating resin 10, one portion of the body 100.

Since a particle diameter of the first powder particle 20 is greater than a particle diameter of the second powder particle 30, the plating prevention film 21 may be formed on a surface of the first powder particle 20 in general. For example, both the first powder particle 20 and the second powder particle 30 may be exposed from the surface of the body 100, but the second powder particle 30 exposed from the surface of the body 100 may be dissolved in an acidic solution during an acid treatment due to a relatively small particle diameter of the second powder particle 30. The second powder particle 30 may be dissolved in the acidic solution to form voids V in the insulating resin 10 of the outer portion 120. As a result, a volume of each of the voids V formed in the insulating resin 10 of the outer portion 120 may correspond to a volume of the second powder particle 30 remaining in the insulating resin 10 of the outer portion 120. As described above, since the particle diameter of the second powder particle 30 refers to the particle diameter distribution, the volume of the second powder particle 30 means volume distribution. Therefore, the volume of the voids V corresponding to the volume of the second powder particle 30 refers to the fact that the volume distribution in the volume of the voids is substantially equal to the volume distribution in the volume of the second powder particle.

The plating prevention film 21 may be formed using reacting the magnetic metal powder particles 20 and 30 of the outer portion 120 with the acid. The plating prevention film 21 may include, or may be, an oxide of a metal magnetic component constituting the magnetic metal powder particles and be formed by oxidizing the magnetic metal powder particles 20 and 30 by the acid. Therefore, the plating prevention film 21 may be discontinuously formed on each of the first to fifth surfaces 101, 102, 103, 104, and 105 of the body 100. That is, the plating prevention film 21 may be distributed on the first to fifth surfaces 101, 102, 103, 104, and 105 of the body 100 according to a distribution of the magnetic metal powder particles 20 or a distribution of the magnetic metal powder particles 20 and 30 on the first to fifth surfaces 101, 102, 103, 104, and 105 of the body 100. In addition, a concentration of oxygen ions in the plating prevention film 21 may be reduced toward a center of each of the magnetic metal powder particles 20 and 30 from the outside. For example, since the surface of each of the magnetic metal powder particles 20 and 30 is exposed to the acid solution for a period longer than that of the center of each of the magnetic metal powder particles 20 and 30, the concentration of oxygen ions in the plating prevention film 21 may vary, depending on a depth of the plating prevention film 21. As a result, cracks CR may be formed in the plating prevention film 21, due to unbalance of metal ions or the like by the oxidation-reduction reaction. A thickness of the plating prevention film 21 on one of the magnetic metal powder particles 20 and 30 may decrease in a direction from the surface of the body 100 to an inner portion of the body 100. For example, the thickness of the plating prevention film 21 on one of the magnetic metal powder particles 20 and 30 may decrease in a direction substantially perpendicular to the surface of the body 100. In one example, the plating prevention film 21 may cover a first portion of one of the magnetic metal powder particles 20 and 30 and may not cover a second portion of the one of the magnetic metal powder particles 20 and 30 which is farther away from the surface as compared to the first portion. The plating prevention film 21 of the present disclosure may be distinguished from technique in which a separate oxide film is applied or coated on the magnetic metal powder particles 20 and 30.

Since the plating prevention film 21 contains metal ions and oxygen ions of the magnetic metal powder particles 20 and 30, the plating insulation film 21 may be excellent in electrical insulation. Therefore, in forming a plating layer on the external electrodes 400 and 500 to be described later, a plating blurring phenomenon and the like may be prevented without forming a separate plating resist on the surface of the body 100.

The plating prevention film 21 may be formed on a cut surface of each of the magnetic metal powder particles 20 and 30. The cut surface may be a flat surface intersecting the curved outer surface of the remaining portion of the magnetic metal powder particle 20. The coil component 1000 according to this embodiment may form a plurality of unit coils on a substrate of a strip level or a panel level, may stack the magnetic composite sheets, and may then dice the substrate to individualize a plurality of components. In this case, a dicing tip may cut the plurality of components along a dicing line, and the magnetic metal powder particles 20 and 30 arranged on the dicing line may be cut by the dicing tip, to have the cut surface. For the above reason, the cut surface of the magnetic metal powder particles 20 and 30 may be exposed from the first to fourth surfaces 101, 102, 103, and 104 of the body 100, and the plating prevention film 21 may be formed on the cut surface of the magnetic metal powder particles 20 and 30 after the acid treatment. In one example, the dicing operation may not be performed to the fifth surface 105, and thus, the magnetic metal powder particles 20 and 30 having a cut surface may be exposed from only the first to fourth surfaces 101, 102, 103, and 104 of the body 100, and are spaced apart from the fifth and sixth surfaces 105 and 106.

A thickness of the plating prevention film 21 may be more than 0 μm and 20 μm or less. Here, the thickness of the plating prevention film 21 may refer to a thickness of the plating prevention film 21 on a portion of one of the magnetic metal powder particles 20 and 30 facing the surface of the body or exposed from the body 100. When the thickness of the plating prevention film is more than 20 μm, the magnetic properties of the first powder particle 20 may be deteriorated.

As illustrated in FIG. 4, the plating prevention film 21 may be formed on the entire surface of any one of the magnetic metal powder particles 20 and 30 disposed on the outer portion 120, or may be formed only on a region of any one of the magnetic metal powder particles 20 and 30.

The body 100 may include a magnetic core C passing through the coil portion 300 to be described later. The magnetic core C may be formed by filling the through-holes of the coil portion 300 with the magnetic composite sheet, but is not limited thereto.

The inner insulating layer 200 may be embedded in the body 100. The inner insulating layer 200 may be configured to support the coil portion 300 to be described later.

The inner insulating layer 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the inner insulating layer 200 may be formed of an insulating material such as prepreg, Ajinomoto Build-up Film (ABF), FR-4, a bismaleimide triazine (BT) resin, a photoimageable dielectric (PID), a copper clad laminate (CCL), and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the inner insulating layer 200 is formed of an insulating material including a reinforcing material, the inner insulating layer 200 may provide better rigidity. When the inner insulating layer 200 is formed of an insulating material not containing glass fibers, the inner insulating layer 200 may be advantageous for reducing a thickness of the overall coil portion 300. When the inner insulating layer 200 is formed of an insulating material containing a photosensitive insulating resin, the number of processes for forming the coil portion 300 may be reduced. Therefore, it may be advantageous in reducing production costs, and a fine via may be formed.

The coil portion 300 may be embedded in the body 100 to manifest the characteristics of the coil portion. For example, when the coil component 1000 of this embodiment is used as a power inductor, the coil portion 300 may function to stabilize the power supply of an electronic device by storing an electric field as a magnetic field and maintaining an output voltage.

The coil portion 300 may be formed on at least one of both surfaces of the inner insulating layer 200, and may form at least one turn. In this embodiment, the coil portion 300 may include first and second coil patterns 311 and 312 formed on both surfaces of the inner insulation layer 200 opposing each other in the thickness direction T of the body 100, and a via 320 passing through the inner insulating layer 200 to connect the first and second coil patterns 311 and 312 to each other.

Each of the first coil pattern 311 and the second coil pattern 312 may have a spiral planar shape forming at least one turn with reference to the magnetic core C. For example, the first coil pattern 311 may format least one turn with reference to the magnetic core C on a lower surface of the inner insulating layer 200 and the second coil pattern 312 may form at least one turn with reference to the magnetic core C on an upper surface of the inner insulation layer 200, based on the direction of FIG. 3.

End portions of the first and second coil patterns 311 and 312 may be connected to the first and second external electrodes 400 and 500, respectively, which will be described later. For example, the end portions of the first coil pattern 311 may be connected to the first external electrode 400, and the end portions of the second coil pattern 312 may be connected to the second external electrode 500.

As an example, the end portions of the first coil pattern 311 may extend to be exposed from the first surface 101 of the body 100, and the end portions of the second coil pattern 312 may extend to be exposed from the second surface 102 of the body 100, to be in contact with and be connected to the first and second external electrodes 400 and 500, formed on the first and second surfaces 101 and 102 of the body 100, respectively. In this case, each of the coil patterns 311 and 312 including the end portions may be integrally formed.

At least one of the coil patterns 311 and 312, and the via 320 may include at least one conductive layer.

For example, when the second coil pattern 312 and the via 320 are formed on a side of the other surface of the inner insulating layer 200 by a plating process, the second coil pattern 312 and the via 320 may be formed using a seed layer of electroless plating layers, or the like, and an electroplating layer. In this case, each of the seed layer and the electroplating layer may have a single-layer structure or a multilayer structure. The electroplating layer of the multilayer structure may be formed using a conformal film structure in which one electroplating layer is covered by another electroplating layer, and another electroplating layer is only stacked on one side of the one electroplating layer, or the like. The seed layer of the second coil pattern 312 and the seed layer of the via 320 may be integrally formed, and no boundary therebetween may occur, but are not limited thereto. The electroplating layer of the second coil pattern 312 and the electroplating layer of the via 320 may be integrally formed, and no boundary therebetween may occur, but are not limited thereto.

As another example, referring to FIGS. 2 and 3, when the first coil pattern 311 disposed on a side of the lower surface of the inner insulating layer 200 and the second coil pattern 311 disposed on a side of the upper surface of the inner insulating layer 200 are separately formed, and are then stacked on the inner insulating layer 200 in a batch, the via 320 may include a high melting point metal layer, and a low melting point metal layer having a melting point lower than a melting point of the high melting point metal layer. In this case, the low melting point metal layer may be formed of a solder containing lead (Pb) and/or tin (Sn). The low melting point metal layer may be melted at least in part due to the pressure and the temperature at the time of stacking in a batch. As a result, an intermetallic compound (IMC) layer may be formed at least at a portion of a boundary between the low melting point metal layer and the second coil pattern 312, and a boundary between the low melting point metal layer and the high melting point metal layer.

The coil patterns 311 and 312 may protrude from both surfaces of the inner insulating layer 200, for example, based on the directions of FIGS. 2 and 3. As another example, based on the directions of FIGS. 2 and 3, the first coil pattern 311 may protrude from one surface of the inner insulating layer 200, the second coil pattern 312 may be embedded in the other surface of the inner insulating layer 200, to expose one surface of the second coil pattern 312 from the other surface of the inner insulating layer 200. In this case, since a recess may be formed in the one surface of the second coil pattern 312, the other surface of the inner insulating layer 200 and the one surface of the second coil pattern 312 may not be located on the same plane. As another example, based on the directions of FIGS. 2 and 3, the second coil pattern 312 may protrude from the other surface of the inner insulating layer 200, and the first coil pattern 311 may be embedded in one surface of the inner insulating layer 200, to expose one surface of the first coil pattern 311 from the one surface of the inner insulating layer 200. In this case, since a recess may be formed in the one surface of the first coil pattern 312, the one surface of the inner insulating layer 200 and the one surface of the first coil pattern 312 may not be located on the same plane.

Each of the coil patterns 311 and 312 and the via 320 may be formed of a conductive material such as copper (Cu), aluminum (Al), silver (Ag), tin (Sn), gold (Au), nickel (Ni), lead (Pb), titanium (Ti), or alloys thereof, but are not limited thereto.

The external electrodes 400 and 500 may be disposed to be spaced from each other on the sixth surface 106 of the body 100, and may be connected to both end portions of the coil portion 300, respectively. In particular, the first external electrode 400 may include a first connection portion 410 disposed on the first surface 101 of the body 100 and connected to an end portion of the first coil pattern 311, and a first pad portion 420 extending from the first connection portion 410 to the sixth surface 106 of the body 100. The second external electrode 500 may include a second connection portion 510 disposed on the second surface 102 of the body 100 and connected to an end portion of the second coil pattern 312, and a second pad portion 520 extending from the second connection portion 510 to the sixth surface 106 of the body 100. Since the first pad portion 410 and the second pad portion 510 respectively disposed on the sixth surface of the body 100 are spaced apart from each other, an electrical short between the first external electrode 400 and the second external electrode 500 may be prevented.

The external electrodes 400 and 500 electrically connect the coil component 1000 to a printed circuit board or the like, when the coil component 1000 according to this embodiment is mounted on the printed circuit board or the like. For example, the coil component 1000 according to this embodiment may be mounted such that the sixth surface 106 of the body 100 faces an upper surface of the printed circuit board, the pad portions 420 and 520 of the external electrodes 400 and 500 may be electrically connected to the connection portions of the printed circuit board.

The external electrodes 400 and 500 may be formed of a conductive material such as copper (Cu), aluminum (Al), silver (Ag), tin (Sn), gold (Au), nickel (Ni), lead (Pb), chromium (Ti), titanium (Ti), or alloys thereof, but are not limited thereto.

Each of the external electrodes 400 and 500 may be formed in a multilayer structure. For example, each of the external electrodes 400 and 500 may include a first metal layer (L1) disposed to contact the surface of the body 100, and second metal layers (L2 and L3) arranged on the first metal layer (L1) and thicker than the first metal layer (L1). The first metal layer (L1) may be formed by a vapor deposition process such as sputtering. In this case, at least a portion of metal elements constituting the first metal layer (L1) may pass through the surface of the body. The second metal layers (L2 and L3) may be formed by an electrolytic plating process using the first metal layer (L1) as a seed layer. The second metal layers (L2 and L3) may be formed in a multilayer structure and may include a first plating layer (L2) and a second plating layer (L3) formed on the first plating layer (L2). For example, the first metal layer (L1) may include copper (Cu), the first plating layer (L 2) may include nickel (Ni), and the second plating layer (L3) may include tin (Sn).

Since the first metal layer (L1) is formed by a vapor deposition process such as sputtering, the first metal layer (L1) may be formed on the first and second surfaces 101 and 102 of the body 100 on which the plating prevention film 21 is formed. As a result, the first metal layer (L1) may be formed to contact both end portions of the coil portion 300. The plating prevention film 21 may function as a plating resist in forming the first plating layer (L2) and the second plating layer (L3) by an electrolytic plating process. The plating prevention film 21 may prevent plating blur or the like in which the first plating layer (L2) and the second plating layer (L3) are extended to regions, except a region in which the external electrodes 400 and 500 are formed in the surface of the body 100.

The external insulating layer 700 may be disposed between the sixth surface 106 of the body 100 and the first and second external electrodes 400 and 500. Specifically, the external insulating layer 700 may be disposed on the sixth surface 106 of the body 100, and the pad portions 420 and 520 of the external electrodes 400 and 500 may be arranged to be spaced apart from each other on the external insulating layer 700. The external insulating layer 700 may increase the insulation distance between the first and second external electrodes 400 and 500, to improve breakdown voltage (BDV) of the coil component 1000 according to this embodiment.

In addition, the external insulating layer 700 may lower surface roughness of the exposed surfaces of the first and second external electrodes 400 and 500. For example, since the body 100 shrinks due to heating and pressurization in the forming process, the surface of the body 100 may have a relatively high surface roughness. When external electrodes, which may be relatively thin, are directly formed on a surface of a body, surface roughness of the exposed surface of the external electrodes may be increased. However, in the case of this embodiment, since an external insulating layer 700 may be formed on the sixth surface 106 of the body 100, and pad portions 420 and 520 of the external electrodes 400 and 500 may be formed on the external insulating layer 700, the external insulating layer 700 may reduce the relatively high surface roughness of the sixth surface 106 of the body 100 to lower the surface roughness of the exposed surface of the pad portions 420 and 520.

The external insulating layer 700 may include a thermoplastic resin such as a polystyrene-based resin, a vinyl acetate-based resin, a polyester-based resin, a polyethylene-based resin, a polypropylene-based resin, a polyamide-based resin, a rubber-based resin, an acrylic-based resin, or the like, a thermosetting resin such as a phenol-based resin, an epoxy-based resin, a urethane-based resin, a melamine-based resin, an alkyd-based resin, or the like, a photosensitive resin, parylene, $SiO_x$, or $SiN_x$.

The external insulating layer 700 may be formed by applying a liquid insulating resin to the sixth surface 106 of the body 100, by stacking an insulating film on the sixth surface 106 of the body 100, or by forming an insulating resin on the sixth surface 106 of the body 100, using a vapor deposition process. In the case of the insulating film, a dry film (DF) containing a photosensitive insulating resin, an Ajinomoto Build-up Film (ABF) containing no photosensitive insulating resin, a polyimide film, or the like may be used. Further, the insulating film may include a reinforcing material such as glass fiber or an inorganic filler, and an insulating resin. When the insulating film is stacked on the surface of the body 100 and the insulating film is heated and pressed to form the external insulating layer 700, it is advantageous that the exposed surface of the external electrodes 400 and 500 may be formed to be flatter.

The external insulating layer 700 may be formed in a thickness range of 10 nm to 100 μm. When the thickness of the external insulating layer 700 is less than 10 nm, the Q characteristic, the breakdown voltage (BDV), the self-resonant frequency (SRF) may decrease to deteriorate the characteristics of the component. When the thickness of the external insulating layer 700 exceeds 100 μm, the thickness of the component may increase, to be disadvantageous for thinning.

A cover insulating layer 800 may be disposed on the first to fifth surfaces 101, 102, 103, 104, and 105 of the body 100 to cover at least a portion of each of the first and second external electrodes 400 and 500. Specifically, the cover insulating layer 800 may be disposed on the first to fifth surfaces 101, 102, 103, 104, and 105 of the body 100, to cover the connection portions 410 and 510 of the external electrodes 400 and 500, and to expose the pad portions 420 and 520.

The cover insulating layer 800 may include at least one of a thermoplastic resin such as a polystyrene-based resin, a vinyl acetate-based resin, a polyester-based resin, a polyethylene-based resin, a polypropylene-based resin, a polyamide-based resin, a rubber-based resin or an acrylic-based resin, or the like, a thermosetting resin such as a phenol-based resin, an epoxy-based resin, a urethane-based resin, a melamine-based resin, an alkyd-based resin, or the like, and a photosensitive resin.

The cover insulating layer 800 may be formed by stacking an insulating film on the first to fifth surfaces 101, 102, 103, 104, and 105 of the body 100, for example. As another example, the cover insulating layer 800 may be formed on the first to fifth surfaces 101, 102, 103, 104, and 105 of the body 100 by forming a material using a vapor deposition process such as chemical vapor deposition (CVD).

The cover insulating layer 800 may be formed in a thickness range of 10 nm to 100 μm. When the thickness of the cover insulating layer 800 is less than 10 nm, the insulating properties may be deteriorated, and possibility that the connection portions 410 and 510 are electrically short-circuited with other components outside the coil component may increase. When the thickness of the cover insulating layer 800 may be more than 100 μm, the total length and width of the coil component may increase, to be disadvantageous for miniaturization of components.

The coil component 1000 according to this embodiment may further include an insulating film 600 formed along the surfaces of the coil patterns 311 and 312, the inner insulating layer 200, and the magnetic core C. The insulating film 600 may be for insulating the coil patterns 311 and 312 from the body 100, and may include a known insulating material such as parylene. An insulating material included in the insulating film 600 may be any insulating material, and is not particularly limited. The insulating film 600 may be formed using a vapor deposition process or the like, but not limited thereto, and may be formed by stacking an insulating film on both surfaces of the inner insulating layer 200.

Second Embodiment

Figure 6:
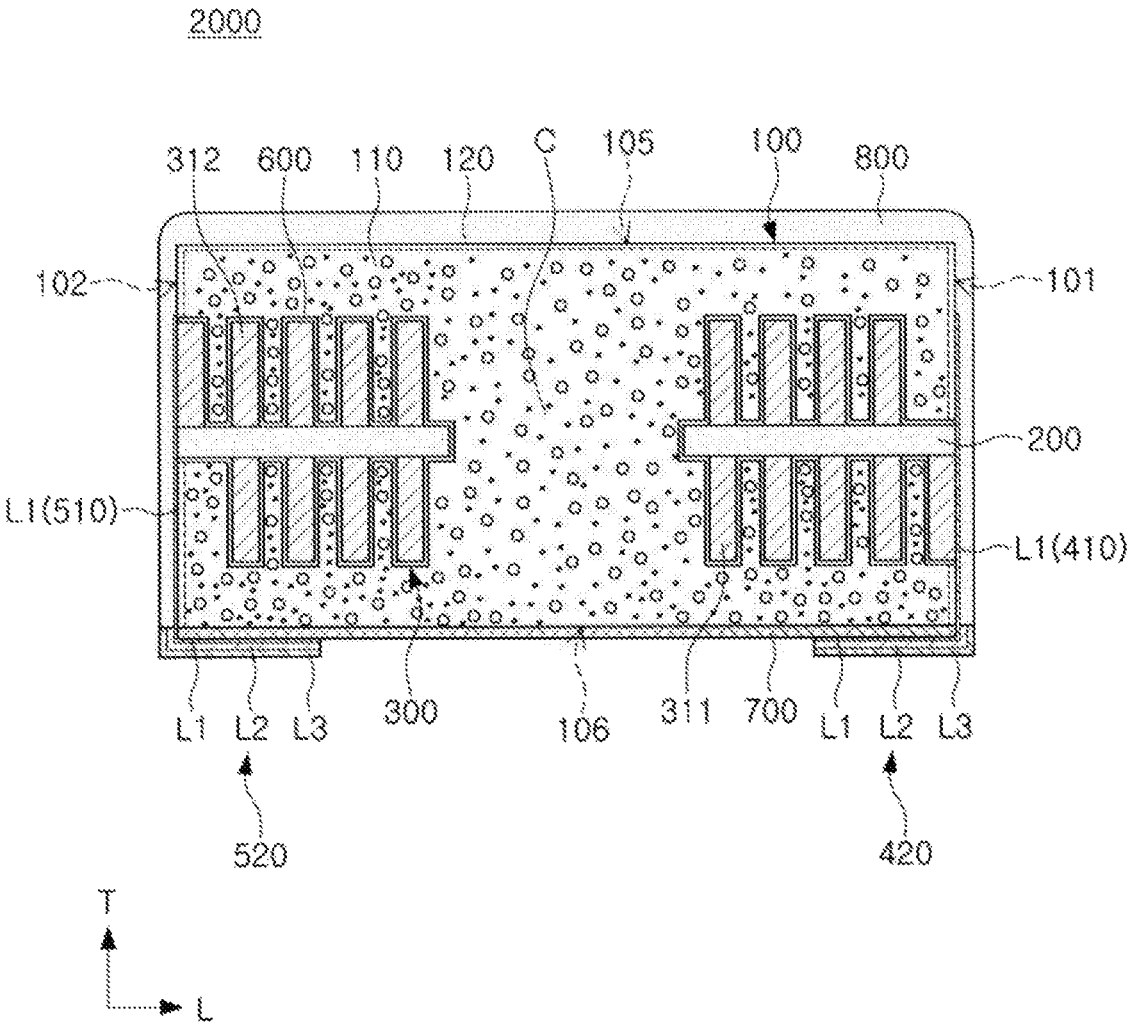
FIG. 6 is a schematic view illustrating a coil component according to a second embodiment of the present disclosure, corresponding to a cross-section taken along line I-I' of FIG. 1.

FIG. 6 is a schematic view illustrating a coil component according to a second embodiment of the present disclosure, corresponding to a cross-section taken along line I-I' of FIG. 1.

Referring to FIGS. 1 to 6, a coil component 2000 according to this embodiment may be different from the coil component 1000 according to the first embodiment of the present disclosure, in view of external electrodes 400 and 500. Therefore, in describing this embodiment, only the external electrodes 400 and 500 different from the first embodiment of the present disclosure will be described. The remaining configuration of this embodiment may be applied, as it is in the first embodiment of the present disclosure.

Referring to FIG. 6, second metal layers (L2 and L3) of external electrodes 400 and 500 according to this embodiment may not be arranged in a region of a first metal layer (L1) disposed on the first and second surfaces 101 and 102 of the body 100. For example, second metal layers (L2 and L3) applied to this embodiment may be arranged only on the pad portions 420 and 520 of the external electrodes 400 and 500, and may not be arranged on the connection portions 410 and 510 of the external electrodes 400 and 500.

A difference between this embodiment and the first embodiment of the present disclosure may be attributed to a sequential relationship between an operation of forming the second metal layers (L2 and L3) and an operation of forming the cover insulating layer 800. For example, in the case of the first embodiment of the present disclosure, the cover insulating layer 800 may be formed after the second metal layers (L2 and L3) are formed on the body 100. In this embodiment, after only the metal layer (L1) is formed on the body 100, the cover insulating layer 800 may be formed, and then the second metal layers (L2 and L3) may be formed by an electrolytic plating process.

Third Embodiment

Figure 7:
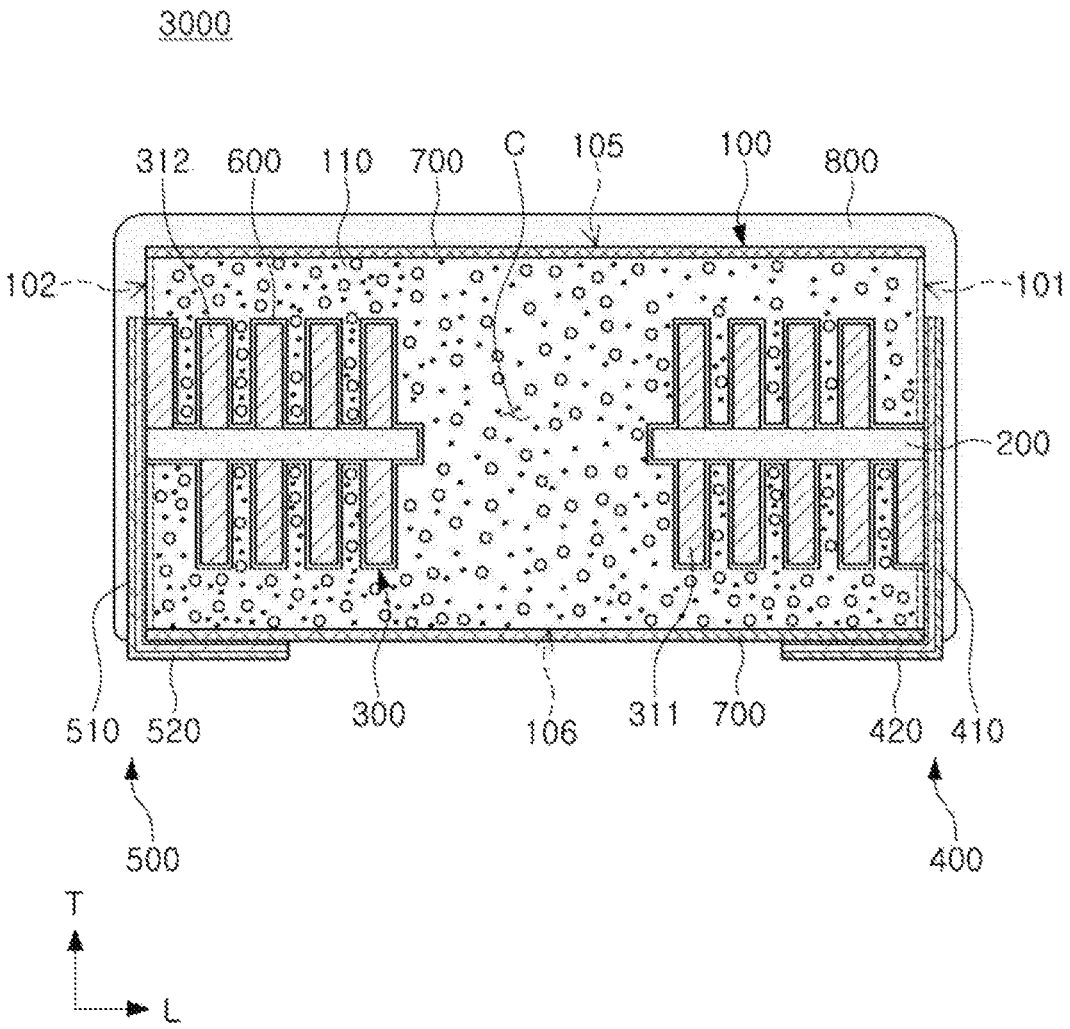
FIG. 7 is a schematic view illustrating a coil component according to a third embodiment of the present disclosure, corresponding to a cross-section taken along line I-I' of FIG. 1.

FIG. 7 is a schematic view illustrating a coil component according to a third embodiment of the present disclosure, corresponding to a cross-section taken along line I-I' of FIG. 1.

Referring to FIGS. 1 to 7, a coil component 3000 according to this embodiment may be different from the coil components 1000 and 2000 according to the first and second embodiments of the present disclosure, in view of an external insulating layer 700. Therefore, in describing this embodiment, only the external insulating layer 700 different from the first and second embodiments of the present disclosure will be described. The remaining configuration of this embodiment may be applied, as it is in the first embodiment or the second embodiment of the present disclosure.

Referring to FIG. 7, an external insulating layer 700 applied to this embodiment may be also disposed on the fifth surface 105 of the body 100. For example, the external insulating layer 700 may be disposed on each of the fifth and sixth surfaces 105 and 106 of the body 100.

In this embodiment, after the external insulating layer is disposed on the fifth and sixth surfaces 105 and 106 of the body 100, an acid treatment process for forming the plating prevention film 21 may be carried out. Therefore, in a different manner to the first embodiment of the present disclosure, an outer portion 120 may constitute only the first to fourth surfaces 101, 102, 103, and 104 of the body 100, not the fifth surface 105 of the body 100.

According to the present disclosure, it is possible to prevent deteriorations in reliability due to plating blur in a plating process for forming external electrodes.

In addition, according to the present disclosure, it is possible for the coil component to become lighter, thinner, shorter, and smaller.

Also, according to the present disclosure, breakdown voltage (BDV) may be improved by increasing the insulation distance between the external electrodes.

While example embodiments have been shown and described above, it will be apparent to those skilled in the art that modifications and variations could be made without departing from the scope of the present disclosure as defined by the appended claims.

What is claimed is:

1. A coil component comprising:

a body having one surface and the other surface opposing each other, having a plurality of wall surfaces respectively connecting the one surface and the other surface, and including magnetic metal powder particles and an insulating resin;

a coil portion embedded in the body and having end portions respectively exposed from end surfaces opposing each other, among the plurality of wall surfaces of the body;

first and second external electrodes arranged to be spaced apart from each other on the one surface of the body, and extending to the end surfaces of the body to be connected to both end portions of the coil portion, respectively; and an external insulating layer disposed between each of the first and second external electrodes and the one surface of the body, wherein a magnetic metal powder particle exposed on the wall surface of the body, among the magnetic metal powder particles, has a plating prevention film disposed on at least a portion of a surface of the exposed magnetic metal powder particle and including metal elements of the exposed magnetic metal powder particle, and the plating prevention film includes a portion disposed outside the body to be in contact with one of the first and second external electrodes and another portion disposed in the body to be spaced apart from the one of the first and second external electrodes.

2. The coil component according to claim 1, wherein the plating prevention film has a crack.

3. The coil component according to claim 1, wherein a concentration of oxygen in the plating prevention film decreases toward a central portion of the exposed metallic magnetic powder particle.

4. The coil component according to claim 1, wherein the insulating resin has a void.

5. The coil component according to claim 4, wherein the magnetic metal powder particle comprises a first powder particle and a second powder particle having a smaller particle diameter than the first powder particle, wherein a volume of the void corresponds to a volume of the second powder particle.

6. The coil component according to claim 1, wherein the magnetic metal powder particle exposed from the plurality of wall surfaces of the body has a cut surface, wherein the plating prevention film is disposed on at least a portion of the cut surface.

7. The coil component according to claim 1, wherein a thickness of the plating prevention film is more than 0 and not more than 20 μm.

8. The coil component according to claim 1, wherein the plating preventing film is discontinuously distributed in each of the plurality of wall surfaces of the body.

9. The coil component according to claim 1, wherein at least a portion of a magnetic metal powder particle disposed in the body and covered with the insulating resin, among the magnetic metal powder particles, has the plating prevention film on at least a portion of a surface of the covered magnetic metal powder particle.

10. The coil component according to claim 1, wherein the external insulating layer is disposed on the one surface and the other surface of the body, respectively.

11. The coil component according to claim 1, wherein each of the first and second external electrodes comprises:

a first metal layer disposed on a surface of the body, and a second metal layer disposed on the first metal layer and thicker than the first metal layer.

12. The coil component according to claim 11, wherein the second metal layer is disposed only on a region of the first metal layer disposed on the one surface of the body among the one surface and the end surfaces of the body.

13. The coil component according to claim 1, wherein the plating prevention film includes an oxide of a metal magnetic component constituting the magnetic metal powder particles.

14. The coil component according to claim 1, wherein a thickness of the plating prevention film decreases in a direction from the wall surface of the body to an inner portion of the body.

15. The coil component according to claim 1, wherein the plating prevention film covers only a portion of the exposed magnetic metal powder particle.

16. The coil component according to claim 1, further comprising a cover insulating layer disposed on the other surface of the body and the plurality of wall surfaces of the body, to cover at least a portion of each of the first and second external electrodes.

17. A coil component comprising:

a body comprising a magnetic metal powder particle and an insulating resin;

a coil portion embedded in the body;

first and second external electrodes arranged to be spaced apart from each other on one surface of the body, and extending to end surfaces of the body to be connected to end portions of the coil portion, respectively; and an external insulating layer disposed between each of the first and second external electrodes and the one surface of the body, wherein an oxide film is at least partially embedded in the body and covers only a portion of the magnetic metal powder particle, the magnetic metal powder particle covered by the oxide film is spaced apart from the one surface of the body, and the oxide film has a crack being in contact with one of the first and second external electrodes.

18. The coil component according to claim 17, wherein the insulating resin has a void having a volume smaller than that of the magnetic metal powder particle.

19. Coil component according to claim 17, further comprising another external insulating layer disposed on another surface of the body opposing the one surface, wherein the magnetic metal powder particle covered by the oxide film is spaced apart from the another surface of the body.

20. A coil component comprising:

a body having one surface and the other surface opposing each other, having a plurality of wall surfaces respectively connecting the one surface and the other surface, and including magnetic metal powder particles and an insulating resin;

a coil portion embedded in the body and having end portions respectively exposed from end surfaces opposing each other, among the plurality of wall surfaces of the body;

first and second external electrodes arranged to be spaced apart from each other on the one surface of the body, and extending to the end surfaces of the body to be connected to both end portions of the coil portion, respectively; and an external insulating layer disposed between each of the first and second external electrodes and the one surface of the body, wherein a magnetic metal powder particle exposed on the wall surface of the body, among the magnetic metal powder particles, has a plating prevention film disposed on at least a portion of a surface of the exposed magnetic metal powder particle and including metal elements of the exposed magnetic metal powder particle, and the plating prevention film has a crack being in contact with one of the first and second external electrodes.

* * * * *